United States Patent [19]

Leuvelink

[11] 4,423,543

[45] Jan. 3, 1984

[54] METHOD FOR THE PRODUCTION OF A LINK-BELT

[75] Inventor: Gerrit W. E. Leuvelink, Haaksbergen, Netherlands

[73] Assignee: T.T. Haaksbergen B.V., Haaksbergen, Netherlands

[21] Appl. No.: 391,224

[22] Filed: Jun. 23, 1982

Related U.S. Application Data

[62] Division of Ser. No. 149,692, May 14, 1980, Pat. No. 4,345,730.

[30] Foreign Application Priority Data

May 26, 1979 [DE] Fed. Rep. of Germany ..... 2921491

[51] Int. Cl.[3] ..... B23P 19/04

[52] U.S. Cl. ..... 29/433; 29/241; 29/437; 29/445; 245/6; 264/249

[58] Field of Search ..... 29/241, 437, 433, 445; 245/5, 6; 428/98, 221, 257; 140/3 R, 3 CA, 92.5; 264/249

[56] References Cited

U.S. PATENT DOCUMENTS

| | | | |
|---|---|---|---|
| 520,906 | 6/1894 | Tourasse . | |
| 803,659 | 11/1905 | Allen . | |
| 2,254,396 | 5/1941 | Scherfel . | |
| 2,255,452 | 8/1941 | Pink . | |
| 3,376,002 | 3/1965 | Andrews et al. . | |
| 3,476,157 | 11/1969 | De Wulf | 245/6 UX |
| 3,542,188 | 11/1970 | Kinney, Jr. | 245/6 UX |

FOREIGN PATENT DOCUMENTS

| | | | |
|---|---|---|---|
| 742505 | 9/1966 | Canada | 245/5 |
| 2419751 | 12/1975 | Fed. Rep. of Germany . | |

*Primary Examiner*—Charlie T. Moon

*Attorney, Agent, or Firm*—Fleit, Jacobson, Cohn & Price

[57] ABSTRACT

The application discloses a dimensionally stable link-belt comprising a multiplicity of helical coils arranged in interdigitated side-by-side disposition and connected together by respective hinge wires threaded therethrough, and also a method for producing the same wherein either or both of the coils and hinge wires, being of a synthetic thermoplastic monofilament material, deform on subjecting the belt to heat treatment under tension so as to impart dimensional stability to the total structure.

12 Claims, 7 Drawing Figures

METHOD FOR THE PRODUCTION OF A LINK-BELT

This is a divisional of application Ser. No. 149,692 filed May 14, 1980, now U.S. Pat. No. 4,345,730, issued Aug. 24, 1982.

The invention refers to a method for the production of a link-belt including synthetic materials having thermo-setting properties, and has particular, though not exclusive reference to a method for producing such a structure.

It is known to produce a link-belt for use in the context of papermaking machines and the like from a multiplicity of helical coils connected together by hinge wires threaded through the interdigitated turns of adjacent coils, a typical arrangement being shown for example in German Auslegeschrift No. 24 19 751.

In this known arrangement, the coils are connected together in such a way that two successive turns of one coil receive a turn of the next adjacent coil therebetween with the said turn of the adjacent coil in contact with and clamped between the flanks of the said successive turns by virtue of a spring-like tension in the individual coils. It is questionable that such a link-belt provides an adequate degree of dimensional stability.

The object of the invention is to produce a link-belt of the aforesaid kind having improved dimensional stability and selvedge strength as compared with known structures, the belt itself being substantially flat and the hinge wires being firmly fixed in position relative to the individual coils.

According to one aspect of the present invention there is proposed a method for the manufacture of a link-belt defined by a multiplicity of helical coils joined in side-by-side disposition by hinge wires of a thermoplastic monofilament material threaded through the interdigitated turns of adjacent such coils, which method includes the steps of arranging adjacent coils in inter-digitated disposition, threading a respective hinge wire through the interdigitated turns of each pair of adjacent coils, subjecting the resultant link structure to a suitable heat setting temperature and longitudinal tension to cause the hinge wires to deform and assume a crimped configuration in the plane of the structure, and subsequently reducing the temperature of the structure.

According to a further preferred feature, adjacent helical coils are of opposite hand.

The method of the invention makes possible the use of relatively simply produced helical coils, the coils being wound for example, in round or oval form. The heating and stretching of the link structure wherein the coils are of a thermoplastic material reshapes originally round or oval coils to a required flat form, wherein flat runs connect curved end regions. Subjecting a link structure having flat coils to tension or subjecting a link structure including initially round or oval coils of a thermoplastic material to a tension beyond that necessary to cause the coil to assume a flat shape will deform the hinge wire and cause the same to assume a crimped form and/or will deform the coil in the region of the hinge wire, according to the physical characteristics of the material of the hinge wire and of the coils.

According to another aspect of the present invention there is proposed a method for the manufacture of a link-belt from a plurality of helical coils of a synthetic thermoplastic material arranged in interdigitated disposition and connected together by respective hinge wires engaged with the interdigitated turns of adjacent coils, the thickness of the monofilament defining the coil approximating to the spacing between successive turns of the said coil, which method comprises the steps of arranging adjacent coils in interdigitated disposition, threading a respective hinge wire through the interdigitated loops of each respective pair of adjacent coils, subjecting the resultant link structure to a heat setting temperature whilst under longitudinal tension thereby to effect a deformation of the material of the coils in those regions thereof whereat the hinge wires are seated to increase the cross-sectional dimension of the said coils in such regions to a level in excess of the spacing between adjacent turns of the said coils as measured in the axial direction of the hinge wires.

The invention will now be described further, by way of example only with reference to the accompanying drawings in which.

Figure 1:
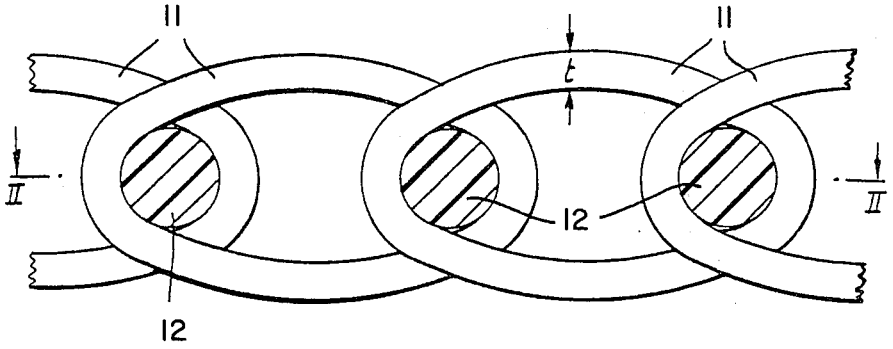
FIG. 1 is a diagrammatic cross-section, drawn to a much enlarged scale, through the link fabric of the invention prior to subjecting the same to heat treatment under tension.

In practising the invention, a hinge belt is first formed by the interdigitation of a multiplicity of individual coils 11 and the introduction of a respective hinge wire 12 into the interdigitated turns of adjacent coils to connect the same together, the thickness t of the material of each of the coils 11 being substantially equal to the spacing d (FIG. 2) between successive turns of each coil. The coils 11 may initially be of the oval form shown in FIG. 1 or may be of circular or flat transverse cross-section.

In accordance with one procedure the hinge belt is tensioned and is then subjected to heat at such a level and for such a period as is sufficient to deform the material of the coils and/or the hinge wires, thus to introduce a degree of stability into the belt.

It is possible, by suitable selection of the physical property of the materials of the coils and of the hinge wires, to effect on thermal setting and stretching deformation of either or both of the coils and the hinge wires, thereby to impart stability in different ways.

Figure 2:
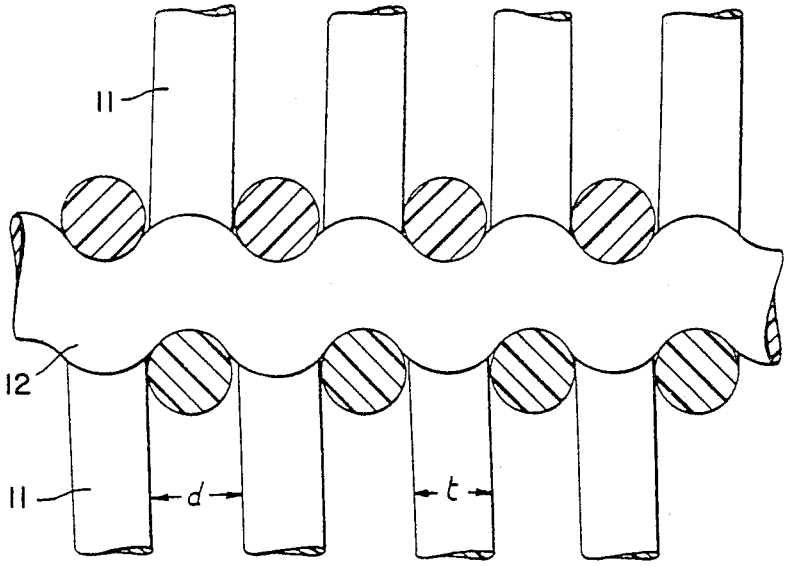
FIG. 2 is a section taken on line II—II through the structure shown in FIG. 1 after the same has been subjected to heat when under tension to effect crimping of the hinge wire.

Thus, referring now to FIG. 2, by providing a hinge wire 12 of a synthetic thermoplastic material, and subjecting the belt, when under tension, to a temperature approaching the softening temperature of the material of the hinge wire 12, it being assumed that the coils 11 are either non-thermoplastic or comprise a material having a softening point at a temperature higher than that of the hinge-wire 12, it is possible to cause the hinge wire 12 to assume a crimped form which form will be retained when the hinge wire reverts to temperatures below its softening temperature, the deformation of the surface of the hinge wire in the plane of the structure being at least 5% of the diameter of such hinge wire.

Figure 3:
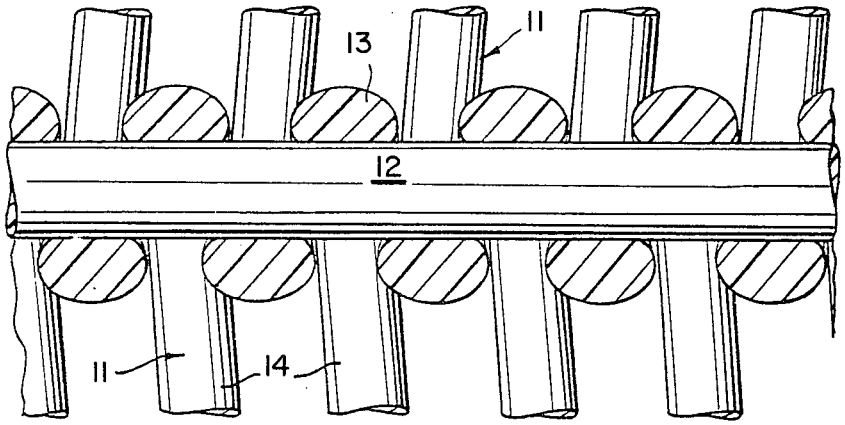
FIG. 3 is a diagrammatic cross-section through a link fabric produced in accordance with another aspect of the method of the invention, and shows deformation of the monofilament of the coil resulting from application of heat to the fabric when under tension.

In an alternative procedure, see now FIG. 3, the hinge wire 12 is of a non-thermoplastic material or is of a synthetic thermoplastic material having a higher softening temperature than the material of the coils 11, and accordingly, on subjecting a tensioned link belt to a temperature approaching the softening temperature of the material of the coil (but much less than the softening temperature of the hinge wire if the same is of a synthetic thermoplastic material) deformation of the coils in the end regions 13 of the individual turns 14 thereof occurs in such manner as will more firmly connect the coils together and improve the stability of a link fabric.

Figure 4:
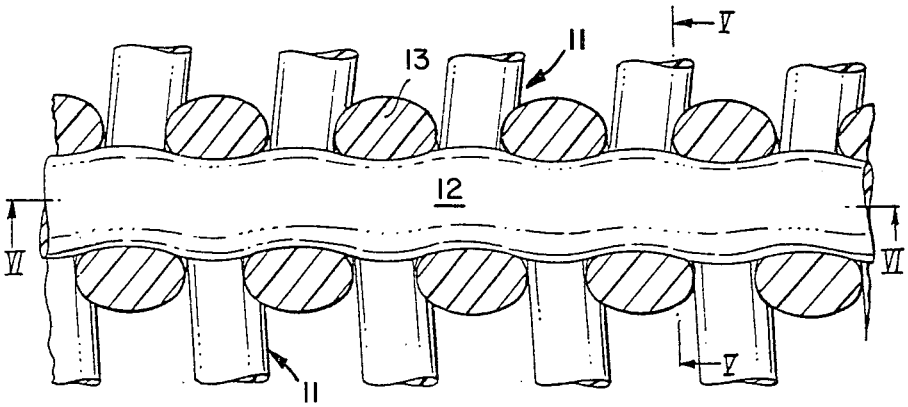
FIG. 4 is a cross-section through a link fabric produced in accordance with the invention, and illustrates both deformation of the monofilament of the coil and crimping of the hinge wire.
Figure 5:
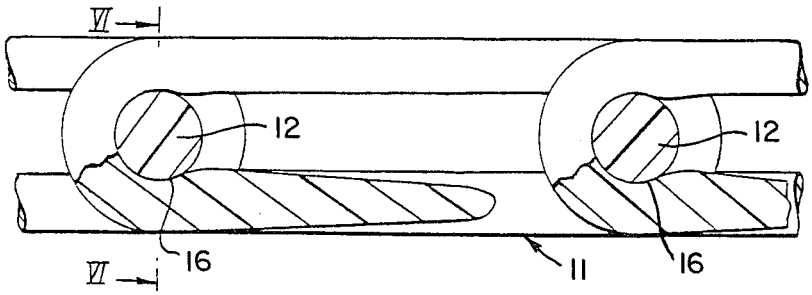
FIG. 5 is a section on line V—V of FIG. 4.
Figure 6:
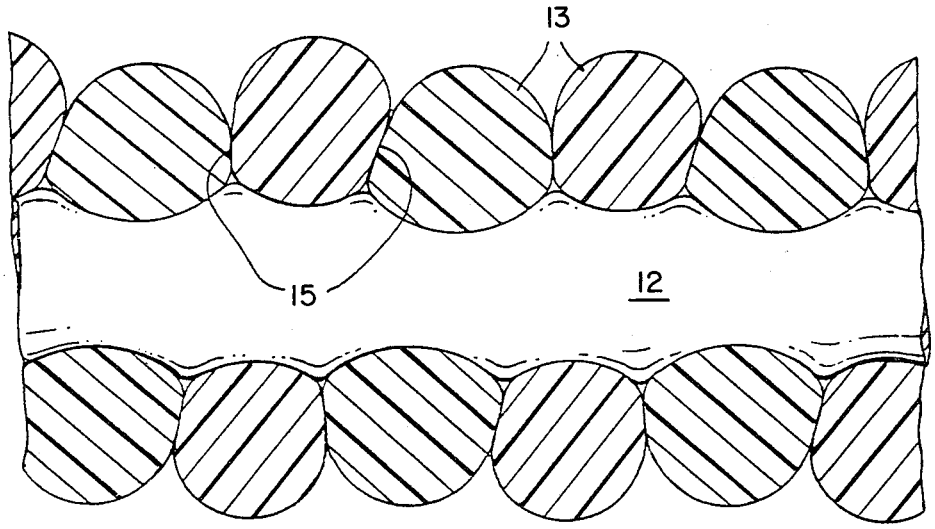
FIG. 6 is a section on line VI—VI of FIGS. 4 and 5.

In practice, the most effective course is to combine the concept of hinge wire crimp with that of coil deformation, a structure embodying both such characteristics being shown diagrammatically in FIGS. 4 to 6.

Both the helical coils 11, alternate coils being of opposite hand, and the hinge wire 12 of the arrangement shown in FIGS. 4 to 6 are of monofilament polyester material, for example polyethylene terephthalate.

On subjecting the tensioned link belt to heat, the hinge wire 12 is caused to assume the crimped form shown, whilst, subject to the tension being sufficient, the coils are themselves deformed in the end regions 13 thereof to provide alternate enlargements 15 at diametrically opposite sides of the hinge wire 12 in seated register with the crimp and of a dimension in the axial direction of the hinge wire 12 in excess of the spacing d between successive turns 14 of the coils 12.

In a typical example, as seen in FIG. 4, the hinge wire and the coils comprise monofilament yarns of approximately 0.9 and 0.7 mm diameter respectively, the deformation introduced into the hinge wire being such as to create an amplitude of deformation at the surface of the hinge wire of approximately 5% of the yarn diameter and the deformation of the end region of each turn of the individual coils increasing the diameter thereof as measured in the axial direction of the hinge wire by approximately 10%.

In addition to the deformation of the coils readily apparent in FIG. 4, abutting flanks of adjacent coils are also complementarily deformed, as too are the abutting surfaces of the coils and the hinge wires engaged therewith.

The deformation of the hinge wire and the various deformations introduced into the coils (fitting together in intimate contact) combine to impart a high degree of dimensional stability to the link-belt, both in the longitudinal and in the transverse directions thereof, such as make the same eminently suitable for use in the context of papermaking and like machines. The lateral stability is believed to be due largely to the location of successive turns 14 of the coils 11 in the deformation pattern of the hinge wire 12, to the relationship between the increased thickness of the monofilament yarn of the coils and the spacing d between the successive turns thereof, and to the intimate contact between opposite flanks of the end region of a given turn of one coil with the respective opposing flanks of the end regions of the successive turns of the adjacent coil between which the said turn is located, as seen at 15 in FIG. 6.

The longitudinal stability of the fabric, and also its rigidity, is believed to arise from an effective overlap of the enlarged end regions of respective adjacent coils when considered in a direction at right angles to the axis of the hinge wire, from the increased dimension of the end regions in relation to the spacing of successive turns of the individual coils and from the bedding of the hinge wires into the end regions of the coils as seen at 16 in FIG. 5.

According to the degree of stability and/or rigidity required of a link belt, so reliance can be placed on either or both of the hinge wire deformation and coil deformation.

The heating will ordinarily take place at a temperature of between 120° to 250° C., and preferably at a temperature of between 180° C. to 200° C., although this will be determined with particular reference to the characteristics of the thermoplastic material involved.

Typically in producing a spiral fabric in accordance with the invention a polyester monofilament of hydrolysis resistant quality, and of diameter 0.7 mm is converted to spiral form by winding the monofilament onto a forming mandrel with the application of heat. The size and cross-section of the mandrel correspond to the internal size of the spiral and produces an oval spiral of major and minor internal dimensions of 5.3 mm and 2.4 mm. Spirals are produced with left and right hand configurations. A plurality of spirals is combined together and a hinge wire of hydrolysis resistant polyester monofilament of 0.90 mm diameter is inserted down the centre of adjacent intermeshed spirals. The process is repeated until sufficient length of fabric has been produced.

A finishing process is carried out in which the fabric is subjected to tension and heat when mounted on the parallel revolving cylinders of a stretching and heat setting machine. A tension of not less than 5 kg/cm. is applied under a temperature not less than 170° C. This causes the spiral to deform into a flat elongated section of major and minor internal dimensions of 5.8 mm×1.2 mm. Deformation of the hinge wire also occurs which prevents movement of the finished spirals and greatly increases the stability of the fabric. This deformation gives the impression of a crimping of the hinge wire, although it cannot be a true crimp in that its initial length is maintained, and is not less than 8% of its diameter.

The fabric produced as described is finally cut to the required width and the edges are filled with adhesive to prevent damage and unwinding of the spirals during use.

Figure 7:
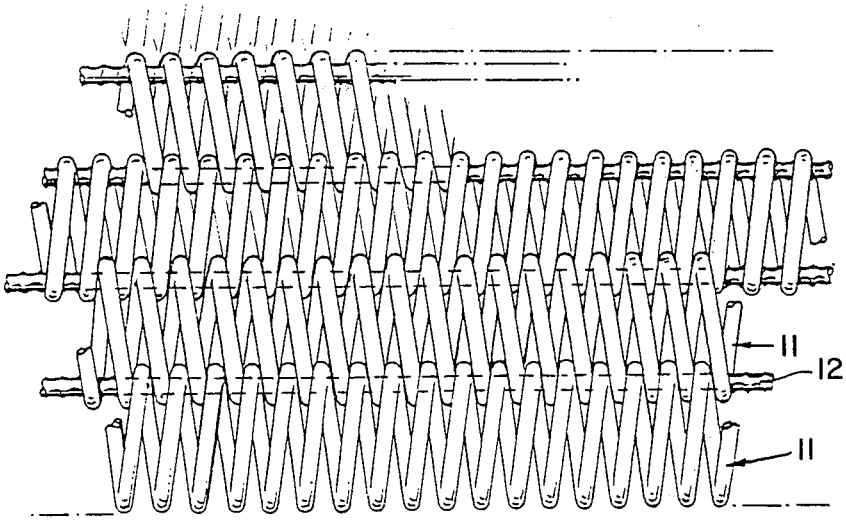
FIG. 7 is a plan view of a part of a link fabric produced in accordance with the invention.

A plan view of a typical link fabric produced in accordance with the present invention is shown in FIG. 7, such fabric comprising a multiplicity of individual coils of a monofilament polyester material arranged in interdigitated side-by-side disposition and adjacent coils being connected together by respective hinge wires threaded through the tunnel formed by such interdigitated coils. Adjacent coils are of opposite hand. The hinge wires are deformed into crimped appearance and the end regions of the individual turns are deformed, the deformation being of the kind shown in FIGS. 4 to 6, and being produced by subjecting the fabric, when under tension, to a suitable heat setting temperature for the polyester material, thus to impart dimensional stability to the fabric.

The dimensional stability which results from a practising of the invention is contrary to all expectations, in that conventional textile technology would suggest that a structure assembled from helical coils and hinge wires would inevitably possess a degree of dimensional stability quite inadequate for such structure to have application in contexts, particularly the contexts of papermachine or like clothing, where dimensional stability is important.

Whilst the stability necessary for use of the fabric in the context of papermachine and like clothing may well require that the thickness of the monofilament forming the coils approximate to the spacing between successive turns of the coils, it is not thought that such requirements exists for conveyor belts which are intended to operate under less stringent conditions, and the invention is accordingly not limited to structures wherein this particular requirement is satisfied. Furthermore, the invention is not limited to the introduction of deformation of the hinge wire and deformation of the end regions of the successive turns of the coils, since advantageous characteristics of the end product as regards its dimensional stability are thought to arise from the introduction of one only of these features.

Although the invention has been disclosed in the context of monofilaments of circular cross-section, it may be preferred in some instances to use monofilaments of different form, for example, of flat cross-section.

I claim:

1. A method for the manufacture of a link belt defined by a multiplicity of helical coils joined in side-by-side disposition by hinge wires of a thermoplastic monofilament material threaded through the interdigitated turns of adjacent such coils, including the steps of arranging adjacent coils in interdigitated disposition, threading a respective hinge wire through the interdigitated turns of each pair of adjacent coils, subjecting the resultant link structure to a suitable heat-setting temperature and longitudinal tension to cause the hinge wires to deform and assume a crimped configuration in the plane of the structure, and subsequently reducing the temperature of the structure.

2. The method as claimed in claim 1, wherein the amplitude of deformation of the surface of the hinge wire in the plane of the structure is at least 5% of the diameter of such hinge wire.

3. The method as claimed in claim 1 wherein the coils are formed of synthetic thermoplastic material.

4. The method as claimed in claim 1, wherein the coils comprise a synthetic thermoplastic monofilament material, adjacent the coils are successively of opposite hand, and the individual coils are initially of circular or oval cross-section when viewed in the axial direction thereof, such coils being caused to assume a flattened form when subjected to tension in the common transverse direction thereof.

5. A method for the manufacture of a link-belt from a plurality of helical coils of a synthetic thermoplastic material arranged in interdigitated disposition and connected together by respective hinge wires engaged with the interdigitated turns of adjacent coils, the thickness of the monofilament defining the coil approximating to the spacing between successive turns of the said coil, comprising the steps of arranging adjacent coils in interdigitated disposition, threading a respective hinge wire through the interdigitated loops of each respective pair of adjacent coils, and subjecting the resultant link structure to a heat setting temperature whilst under longitudinal tension thereby to effect a deformation of the material of the coils in those regions thereof whereat the hinge wires are seated to increase the cross sectional dimension of the said coils in such regions to a level in excess of the spacing between adjacent turns of the said coils as measured in the axial direction of the hinge wires.

6. The method as claimed in claim 5, wherein the deformation of the material of the coils in those regions thereof whereat the hinge wires are seated is approximately 10% of the initial diameter of such material.

7. The method as claimed in claim 5, wherein the hinge wire is of a synthetic thermoplastic material.

8. The method as claimed in claim 7, wherein the structure is subjected to such temperature and tension as to effect deformation both of the coils and the hinge wires.

9. The method as claimed in claim 5, wherein the coils are initially of circular or oval cross-section when viewed in the axial direction thereof, and assume a flattened form when subjected to tension in the common transverse direction thereof.

10. The method as claimed in claim 5, wherein the synthetic thermoplastic material comprises a thermoplastic monofilament.

11. The method as claimed in claim 10, wherein the thermoplastic material is initially of uniform circular cross-section.

12. The method as claimed in claim 5, wherein adjacent coils are of opposite hand.

* * * * *

US004423543B1

REEXAMINATION CERTIFICATE (4161st)

United States Patent [19] [11] B1 4,423,543

Leuvelink [45] Certificate Issued Oct. 3, 2000

[54] METHOD FOR THE PRODUCTION OF A LINK-BELT

[75] Inventor: Gerrit W. E. Leuvelink, Haaksbergen, Netherlands

[73] Assignee: Siteg Siebtechnik GmbH, Ahaus-Alstatte, Germany

Reexamination Request:
No. 90/005,218, Jan. 13, 1999

Reexamination Certificate for:

| | |
|---|---|
| Patent No.: | **4,423,543** |
| Issued: | **Jan. 3, 1984** |
| Appl. No.: | **06/391,224** |
| Filed: | **Jun. 23, 1982** |

Related U.S. Application Data

[62] Division of application No. 06/149,692, May 14, 1980, Pat. No. 4,345,730.

[30] Foreign Application Priority Data

May 26, 1979 [DE] Germany ..... 2921491

[51] Int. Cl.[7] ..... B23P 19/04

[52] U.S. Cl. ..... 29/433; 29/241; 29/437; 29/445; 245/6; 264/249

[58] Field of Search ..... 162/902

[56] References Cited

U.S. PATENT DOCUMENTS

| | | | |
|---|---|---|---|
| 3,032,441 | 5/1962 | Beaumont | 117/138.8 |
| 3,436,041 | 4/1969 | Haller | 245/10 |
| 3,731,892 | 5/1973 | Curran | 245/6 |
| 3,915,202 | 10/1975 | Curtis | 139/425 A |
| 4,142,557 | 3/1979 | Kositske | 139/425 A |
| 4,346,138 | 8/1982 | Lefferts | 428/222 |
| 4,351,874 | 9/1982 | Kirby | 428/229 |

OTHER PUBLICATIONS

Excerpts from Paper Machine Felts and Fabrics; Albany International Corp., pp. 17, 33, 52, 58, 124, 125 (1976).

Excerpts from Wellington Sears Handbook Of Industrial Textiles; Editor, E.R., Kaswell, pp. 137, 138 (1963).

Excerpts from Paper Machine Felts; Editor, L.M. Woodside, pp. 183, 184 (1967).

*Primary Examiner*—I. Cuda

[57] ABSTRACT

The application discloses a dimensionally stable link-belt comprising a multiplicity of helical coils arranged in interdigitated side-by-side disposition and connected together by respective hinge wires threaded therethrough, and also a method for producing the same wherein either or both of the coils and hinge wires, being of a synthetic thermoplastic monofilament material, deform on subjecting the belt to heat treatment under tension so as to impart dimensional stability to the total structure.

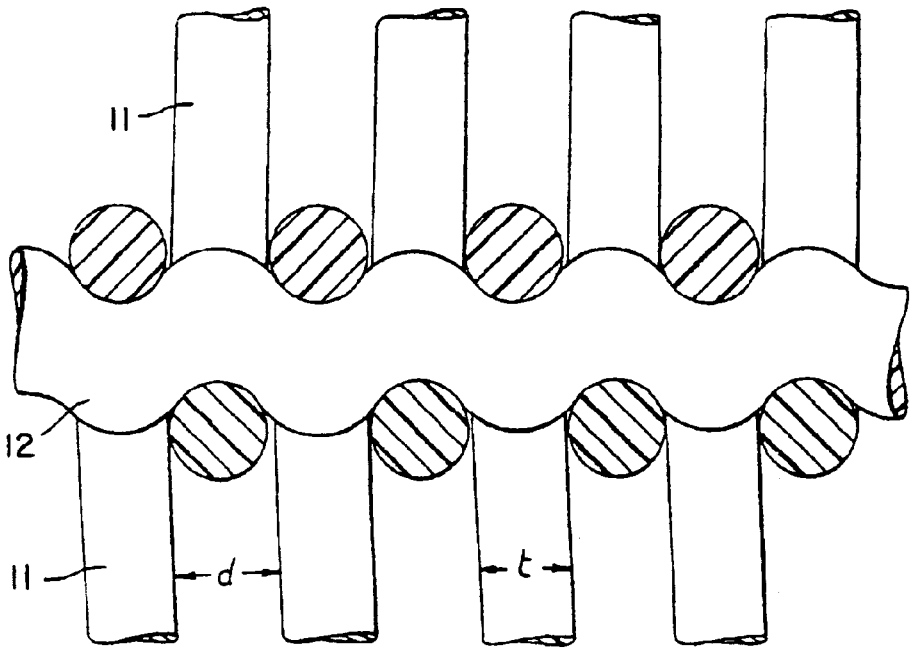

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–12 are cancelled.

* * * * *